US005924231A

United States Patent [19]

Kidd

[11] Patent Number: 5,924,231

[45] Date of Patent: Jul. 20, 1999

[54] TWO STAGE MATCH TRIGGER ASSEMBLY

[76] Inventor: Anthony W. Kidd, 120 Lee Rd., 975, Phenix, Ala. 36870

[21] Appl. No.: 08/990,662

[22] Filed: Dec. 15, 1997

Related U.S. Application Data

[60] Provisional application No. 60/032,907, Dec. 16, 1996.

[51] Int. Cl.[6] ..... F41A 3/00

[52] U.S. Cl. ..... 42/69.03; 42/69.01; 42/42.01; 42/42.03; 42/65

[58] Field of Search ..... 42/69.03, 69.01, 42/42.01, 42.03, 65

[56] References Cited

U.S. PATENT DOCUMENTS

| | | | |
|---|---|---|---|
| 2,626,476 | 1/1953 | Miller | 42/69 |
| 3,152,418 | 10/1964 | Charron | 42/69 |
| 3,797,154 | 3/1974 | Seecamp | 42/69 B |
| 3,889,412 | 6/1975 | Filecci | 42/69 B |
| 4,937,964 | 7/1990 | Crandall | 42/69.03 |
| 5,501,134 | 3/1996 | Milazzo et al. | 89/139 |
| 5,696,346 | 12/1997 | Erning | 89/147 |
| 5,797,206 | 8/1998 | Vitorino | 42/69.03 |

*Primary Examiner*—Charles T. Jordan
*Assistant Examiner*—Meena Chelliah
*Attorney, Agent, or Firm*—Woodard, Emhardt, Naughton Moriarty & McNett

[57] ABSTRACT

A two stage match trigger in which rearward movement of the trigger causes rearward movement of the sear in order to release the hammer. Rearward movement of the sear is resisted by a first stage spring plunger and by a second stage spring plunger. During initial travel of the trigger/sear, only the first stage spring plunger resists motion of the sear. At a point when the sear is close to disengaging from the hammer, the sear encounters the second stage spring plunger, thereby encountering resistance from both the first and second stage spring plungers. The effect produced is an increased force necessary to pull back on the trigger after the sear engages the second stage spring plunger. This provides cues to the shooter that the sear is nearing disengagement from the hammer. Therefore, any further movement of the trigger will cause the rifle to fire. The first stage spring plunger is placed at a greater distance from the trigger than the second stage spring plunger, creating a longer lever arm between the two devices and thereby allowing for a much lighter force to move the trigger than in prior art trigger assembly designs. This lighter pull force is very advantageous when the trigger assembly is used in match competition.

9 Claims, 6 Drawing Sheets

TWO STAGE MATCH TRIGGER ASSEMBLY

CROSS-REFERENCE TO RELATED APPLICATION

This application claims the benefit of U.S. Provisional Application No. 60/032,907, filed Dec. 16, 1996.

TECHNICAL FIELD OF THE INVENTION

The present invention generally relates to firearms and, more particularly, to a two stage match trigger assembly.

BACKGROUND OF THE INVENTION

A completely reliable and adjustable trigger assembly for semi-automatic rifles (i.e., those that automatically cock their triggers after each firing, allowing successive rounds to be fired by repeatedly pulling the trigger) has long been sought by gunsmiths. For example, the Model 10/22 rifle was introduced by RUGER in 1964, and gunsmiths have made countless modifications to the stock trigger assembly during the ensuing years. The trigger, hammer and sear for this rifle have been repeatedly redesigned and manufactured from exotic materials, such as A-2 tool steel, T6 6061 aluminum and titanium, yet no one has achieved a trigger assembly of match quality. In the past, no nationally recognized shooter or gunsmith has thought it possible to compete against bolt action rifles (i.e., rifles that do not automatically cycle), with their superior triggers, using a semi-automatic rifle.

As illustrated in FIG. 1, the RUGER 10/22 rifle trigger assembly, indicated generally at 10, is a single stage trigger assembly. The trigger assembly 10 includes a trigger 12 that pivots at trigger pivot pin 14, a trigger return spring 16, a sear 18, which independently pivots on the pivot pin 14, a safety 20, a disconnector 22 pivoting on the trigger 12 at pin 24, a hammer 26, and a mainspring 28.

In operation, the hammer 26 is cocked, thereby engaging sear hook surface 30 with the hammer hook surface 32. Pulling back on the trigger 12 causes movement of disconnector 22, which in turn causes movement of sear 18. After pulling the trigger 12 a great enough distance, sear 18 has moved far enough to cause disengagement of the hook surfaces 30 and 32, thereby allowing the compressed mainspring 28 to push the hammer 26 into its firing position.

This single stage trigger assembly 10 requires a pull weight of six (6) to eight (8) pounds (on average) to fire. This pull weight is established by the mechanical linkage of the various parts of the trigger assembly 10, and is not adjustable. Also, the hammer-to-sear engagement is not adjustable, and in order to remove the factory creep, the hammer hook surface 32 must be reduced for less engagement with the sear 18. Unfortunately, such modification drastically reduces the reliability of the trigger assembly 10, as the sear 18 will not always engage with the modified hammer 26, causing the rifle to fire unexpectedly.

Finally, the trigger assembly 10 does not incorporate an overtravel stop, which stops the rearward movement of the trigger 12 once the hammer 26 is released by the sear 18. All of the above factors conspire to make the trigger assembly 10 inadequate for match competition.

A more suitable trigger assembly for match competition is marketed by WALTHER under the name GSP and is illustrated in FIG. 2 and indicated generally at 50. The trigger assembly 50 includes a trigger 52, trigger bar 54, sear 56, hammer 58, first stage travel adjustment screw 60, trigger bar engagement screw 62, trigger stop 64, length of pull adjustment screw 66, adjustable first stage weight plunger 68, adjustable second stage weight plunger 70, sear (second stage) engagement screw 72 (sets let-off point), and lock down screw 74 (to secure trigger assembly 50 to the rifle).

The trigger assembly 50 is a two stage trigger. As the trigger 52 is pulled back, it initially encounters resistance from the first stage weight plunger 68, but does not contact the second stage weight plunger 70. Further travel of the trigger 52 eventually encounters resistance from the second stage weight plunger 70 (in addition to the resistance already being provided by the first stage weight plunger 68). The effect perceived by the user is that the trigger 52 pulls back smoothly until the point where the second stage weight plunger 70 comes into play. Thereafter, greater force must be applied to move the trigger 52. If the position of the second stage weight plunger is chosen to coincide with a sear 56 position just prior to hammer 58 release, the shooter may squeeze the trigger 52 until the additional pressure is felt, knowing that any further incremental pull of the trigger 52 will cause the gun to fire. This is a very advantageous trigger operation for precision shooting, such as in match competition.

Even with these improvements, problems still exist in these prior art designs. Perhaps greatest is that the WALTHER GSP requires more than three (3) pounds of pull on the trigger 52 in order to overcome the resistance of the first and second stage weight plungers 68, 70. Such required pull forces create relatively high pressures between the rifle and the shooter's hand, leading to unacceptable inaccuracies in the aiming of the rifle.

There is therefor a need for a trigger assembly for a semi-automatic rifle that is suitable for match competition. The present invention is directed toward meeting this need.

SUMMARY OF THE INVENTION

The present invention relates to a two stage match trigger in which rearward movement of the trigger causes rearward movement of the sear in order to release the hammer. Rearward movement of the sear is resisted by a first stage spring plunger and by a second stage spring plunger. During initial travel of the trigger/sear, only the first stage spring plunger resists motion of the sear. At a point when the sear is close to disengaging from the hammer, the sear encounters the second stage spring plunger, thereby encountering resistance from both the first and second stage spring plungers. The effect produced is an increased force necessary to pull back on the trigger after the sear engages the second stage spring plunger. This provides cues to the shooter that the sear is nearing disengagement from the hammer. Therefore, any further movement of the trigger will cause the rifle to fire. The first stage spring plunger is placed at a greater distance from the trigger than the second stage spring plunger, creating a longer lever arm between the two devices and thereby allowing for a much lighter force to move the trigger than in prior art trigger assembly designs. This lighter pull force is very advantageous when the trigger assembly is used in match competition.

In one form of the invention a two stage match trigger assembly is disclosed, comprising: a first pivot pin; a hammer rotatably mounted to the first pivot pin; biasing means coupled to the hammer and operative to urge the hammer to rotate about the first pivot pin; a second pivot pin; a sear rotatably mounted to the second pivot pin and releasably engaging the hammer, said engagement preventing rotation of the hammer about the first pivot pin; a trigger having a trigger pulling surface, said trigger rotatably mounted to the first pivot pin and releasably engaging the search, wherein rotation of the trigger about the first pivot pin causes rotation of the sear about the second pivot pin; a first stage spring plunger operable to resist rotation of the sear about the second pivot pin; and a second stage spring plunger operable to resist rotation of the sear about the second pivot pin; wherein pulling on the trigger pulling surface causes the trigger to rotate about the first pivot pin, which causes the trigger to engage the sear and thereby rotate the sear about the second pivot point, which causes the sear to compress the first stage spring plunger, then the second stage spring plunger, causing the sear to disengage from the hammer, whereupon the biasing means causes the hammer to rotate about the first pivot point; and wherein the first stage spring plunger is farther from the trigger pulling surface than the second stage spring plunger, resulting in a longer lever arm working on the first stage spring plunger than on the second stage spring plunger when the trigger pulling surface is pulled.

In another form of the invention, a two stage match trigger assembly is disclosed, comprising: a first pivot pin; a hammer rotatably mounted to the first pivot pin; biasing means coupled to the hammer and operative to urge the hammer to rotate about the first pivot pin; a second pivot pin; a sear rotatably mounted to the second pivot pin and releasably engaging the hammer, said engagement preventing rotation of the hammer about the first pivot pin; a pivot bar rotatably mounted to the first pivot pin; a trigger having a trigger pulling surface, said trigger mounted to the pivot bar; a transfer bar rotatably mounted to the pivot bar and releasably engaging the sear; wherein rotation of the pivot bar about the first pivot pin causes rotation of the sear about the second pivot pin; a first stage spring plunger operable to resist rotation of the sear about the second pivot pin; and a second stage spring plunger operable to resist rotation of the sear about the second pivot pin; wherein pulling on the trigger pulling surface causes the pivot bar to rotate about the first pivot pin, which causes the transfer bar to engage the sear and thereby rotate the sear about the second pivot point, which causes the sear to compress the first stage spring plunger, then the second stage spring plunger, causing the sear to disengage from the hammer, whereupon the biasing means causes the hammer to rotate about the first pivot point; and wherein the first stage spring plunger is farther from the trigger pulling surface than the second stage spring plunger, resulting in a longer lever arm working on the first stage spring plunger than on the second stage spring plunger when the trigger pulling surface is pulled.

DETAILED DESCRIPTION OF THE PREFERRED EMBODIMENTS

Figure 1:
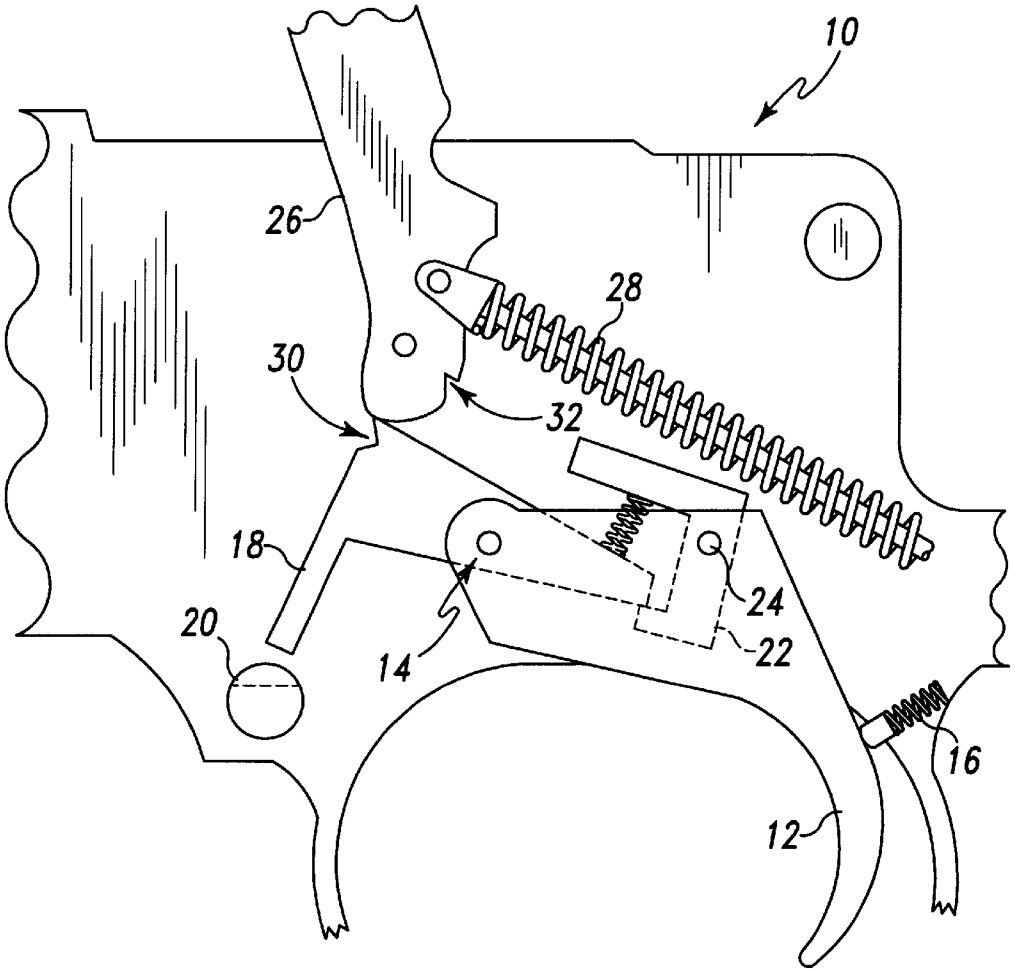
Fig. 1 (PRIOR ART)
FIG. 1 is a schematic diagram of a prior art RUGER 10/22 trigger assembly.
Figure 2:
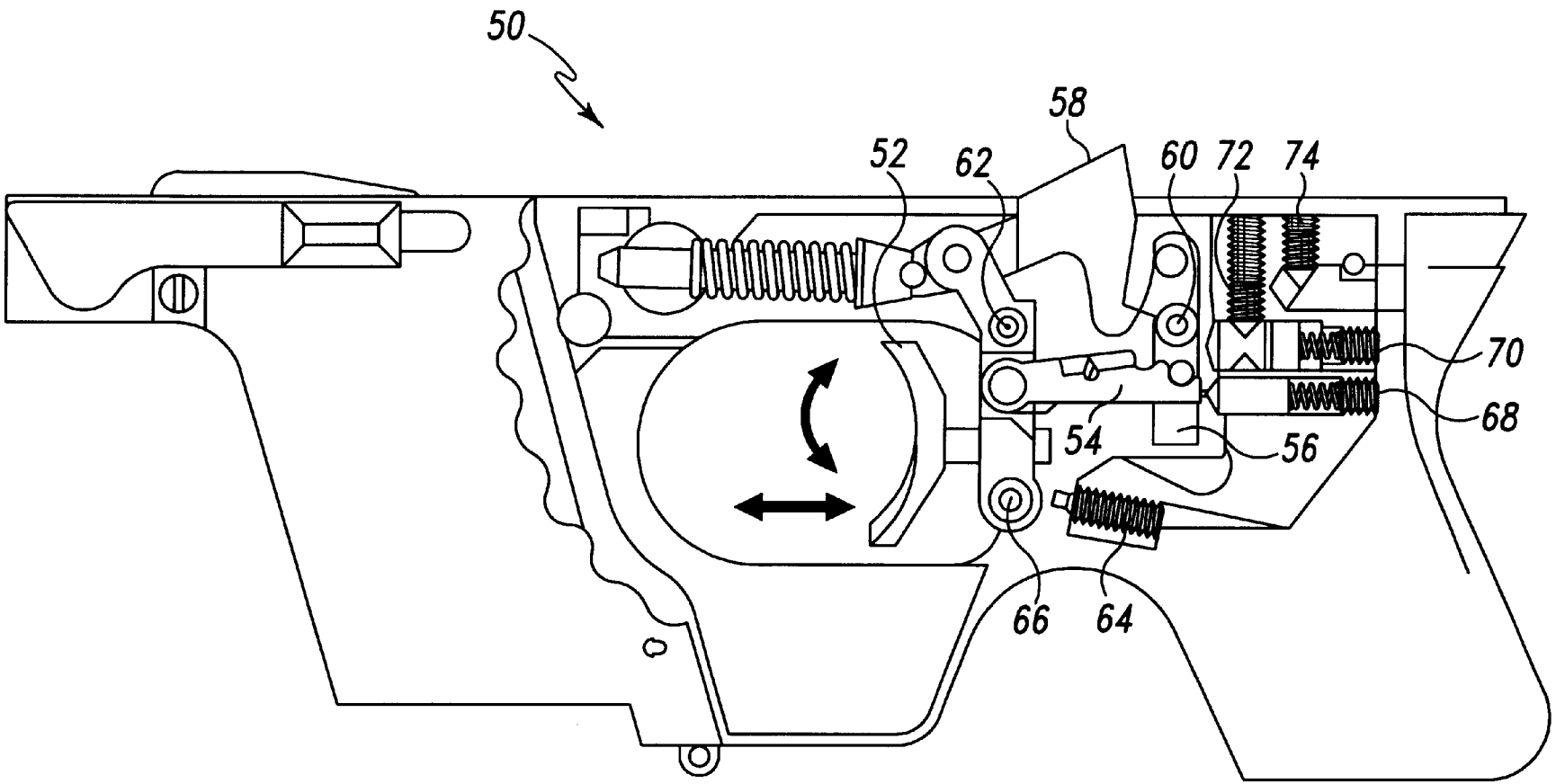
Fig. 2 (PRIOR ART)
FIG. 2 is a schematic diagram of a prior art WALTHER GSP trigger assembly.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3A:
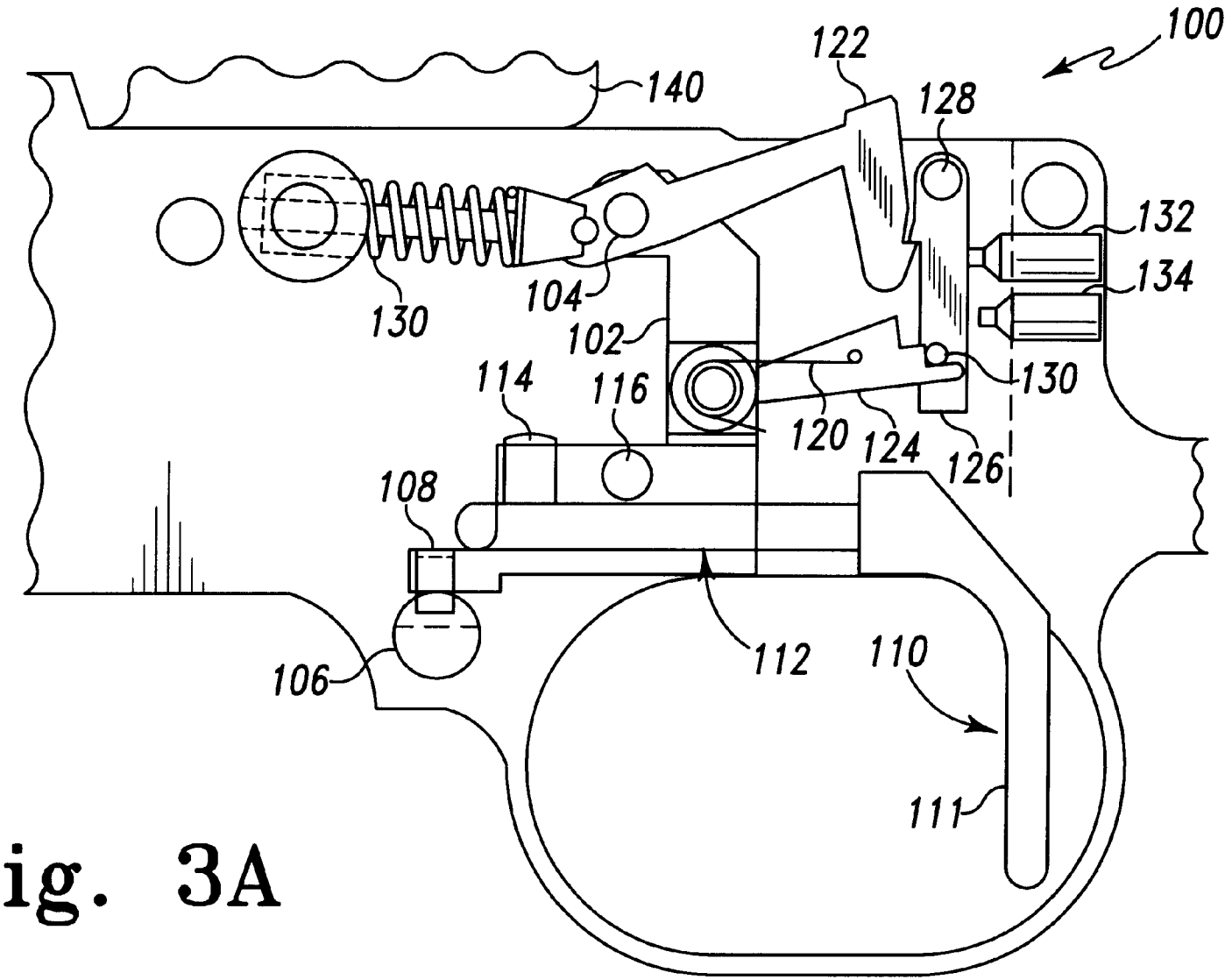
FIGS. 3A–D are schematic diagrams of a preferred embodiment trigger assembly of the present invention, illustrating one complete firing cycle.

Referring to FIG. 3A, a preferred embodiment trigger assembly of the present invention is illustrated and indicated generally at 100. The trigger assembly 100 includes a pivot bar 102 that rotates about the pivot pin 104. At a distal end of the pivot 102, there is provided a safety 106 and a trigger overtravel stop 108. The trigger overtravel stop 108 is a screw which provides an adjustable limit to the distance that the trigger 110 may be pulled. Pulling rearward on the trigger 110 causes the pivot 102 to rotate about the pivot point 104, thereby moving the adjustable overtravel stop 108 in a downward direction. The overtravel stop 108 is adjusted so that after the trigger 110 breaks (i.e., after the rifle is fired), the overtravel stop 108 hits the safety 106, thereby preventing any further rearward movement of the trigger 110. Less muscle movement by the shooter of the rifle produces less movement of the rifle, and therefore greater accuracy.

The trigger 110 includes a pulling surface 111 and is mounted to the pivot 102 within a channel 112 and is locked therein by means of a trigger length adjustment screw 114. By loosening the trigger length adjustment screw 114, the trigger 110 may be moved forward or rearward within the channel 112. Tightening the trigger length adjustment screw 114 fixes the position of the trigger 110. This allows for precise length of pull adjustments.

A trigger position adjustment screw 116 is provided in order to limit the forward travel of the pivot 102. When the trigger 110 is released, the force of the rebounding hammer 122 upon the transfer bar 124 (see FIG. 3C), is transmitted through the spring 120, thereby causing the pivot 102 to move forward.

The trigger assembly 110 further includes a sear 126 which pivots about a pin 128. In FIG. 3A, the hammer 122 is in a cocked position, and is held in this position by engagement with the sear 126. In this position, the mainspring 130 attached to the hammer 122 is in a compressed condition. The gun is fired by pivoting the sear 126 rearward, thereby disengaging it from the hammer 122. Without engagement between the sear 126 and the hammer 122, the compressed mainspring 130 pivots the hammer in a counterclockwise direction about the pivot pin 104. The sear 126 is coupled to the pivot 102 by means of the transfer bar 124 acting upon a pin 130 protruding from the sear 126. Rearward movement of the trigger 110 therefore causes rearward pivoting of the sear 126 by action of the transfer bar 124.

The trigger assembly 100 of the present invention includes two spring plungers 132 and 134 mounted to engage the sear 126 during its rearward pivot. The spring plungers 132 and 134 are preferably Model No. 82412016, manufactured by Jergens of Cleveland, Ohio. The rearward and forward position of each of the spring plungers 132, 134 is adjustable, thereby providing zero to one-half (½) pound resistance at the trigger 110 for each of the plungers 132, 134. In a preferred embodiment, the plungers 132, 134 are each set for a nominal resistance of one-quarter (¼) pound at the trigger 110.

The spring plunger 132 is positioned closer to the sear 126 than the spring plunger 134. The spring plunger 132 is therefore the first stage spring plunger, because it engages the sear 126 prior to engagement of the second stage spring plunger 134. It is an important feature of the present invention that the first stage spring plunger 132 is positioned at a greater distance from the trigger 110 than is the second stage spring plunger 134. This increased distance translates to an increased lever arm between the trigger 110 and the first stage spring plunger 132, thereby requiring a much lighter pressure to be applied to the trigger 110 in order to depress the first stage spring plunger 132.

All of the creep between the sear 126 and the hammer 122 is taken up by depression of the first stage spring plunger 132 up to the point that the sear 126 engages the second stage spring plunger 134. At this point, very little movement of the sear 126 is required to disengage the sear 126 from the hammer 122 and thus fire the rifle. By providing the increased lever arm between the trigger 110 and the first engagement spring plunger 132, a very light pull is created for the trigger assembly 100, without the need to reduce the amount of creep between the sear 126 and the hammer 122. As described in greater detail hereinbelow, this is an important safety feature of the present invention. As a consequence of the positioning of the first and second stage spring plungers of the present invention, the trigger assembly 100 of the present invention has a significantly lighter pull than any other prior art semi-automatic two stage trigger assembly.

In operation, the rifle is fired by pulling the trigger 110 rearward. This action pivots the trigger pivot 102 rearward about the pin 104, and this movement is transferred to the sear 126 through the transfer bar 124. The sear 126 pivots rearward about the pin 128, compressing the first stage spring plunger 132. The first stage spring plunger 132 therefore controls the amount of force upon the trigger 110 that is necessary to move the trigger assembly 110 through its first stage by means of an internal spring-loaded plunger which can be adjusted by an internal adjusting screw.

Upon further compression of the first stage spring plunger 132, the sear 126 contacts the second stage spring plunger 134. The plunger 134 controls the second stage weight by means of an internal spring plunger which can be adjusted by an internal adjusting screw. Almost all of the creep between the sear 126 and the hammer 122 is taken out during compression of the first stage spring plunger 132. By the time the sear 126 contacts the second stage spring plunger 134, there is very little engagement between the sear 126 and the hammer 122. The arrangement of the trigger assembly 100 allows the shooter to gently squeeze the trigger 110 until the additional pressure of the second stage spring plunger 134 is felt. The shooter then knows that almost all of the creep between the sear 126 and the hammer 122 has been removed, and any further incremental movement of the trigger 110 in a rearward direction will cause the rifle to fire.

Figure 3B:
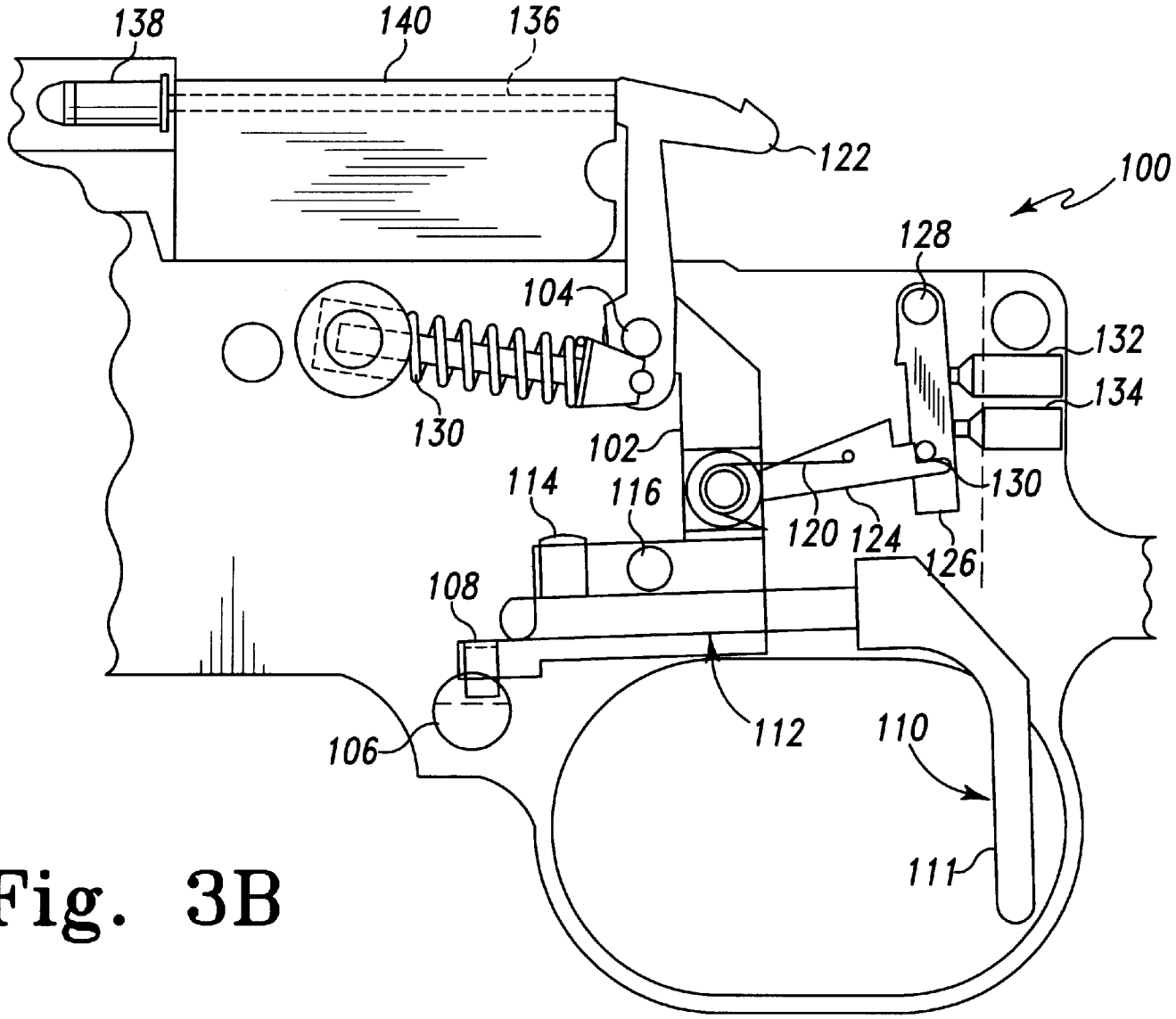

Referring now to FIG. 3B, further movement of the sear 126 beyond the initial position of the second stage spring plunger 134 causes the sear 126 to disengage the hammer 122. The compressed mainspring 130 is therefore free to pivot the hammer 122 in a counterclockwise direction about the pin 104. The hammer 122 then strikes the firing pin 136, which moves in a forward direction and first the chambered cartridge 138.

Figure 3C:
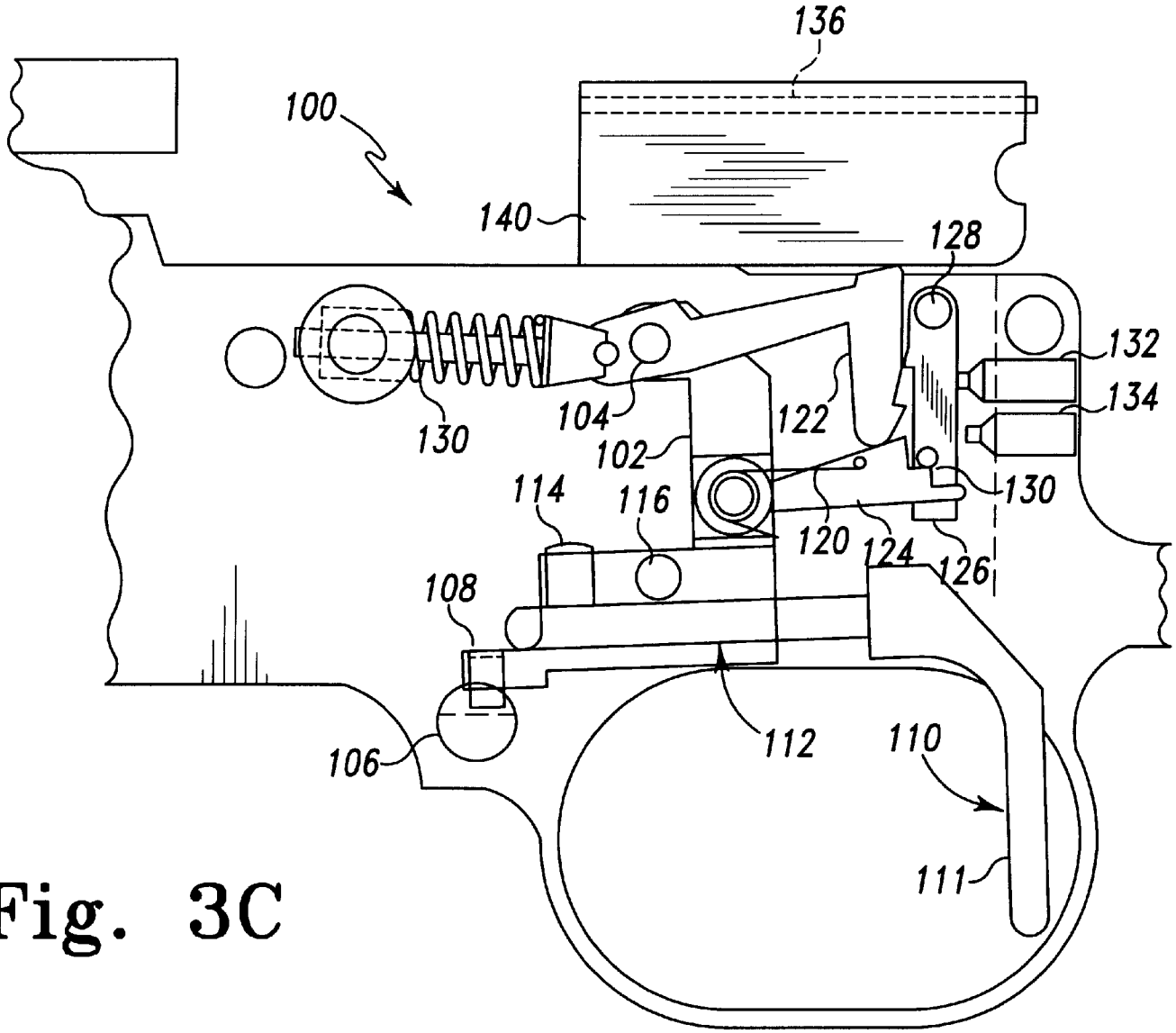

Referring to FIG. 3C, pressure from the fired cartridge 138 moves the bolt 140 rearward along an internal slide (not shown), which in turn causes the hammer 122 to pivot in a clockwise direction, compressing the mainspring 130. The downward movement of the hammer 122 causes it to contact the transfer bar 124. The transfer bar 124 is pivoted downward, disconnecting it from the sear 126. This movement also causes forward movement of the trigger pivot 102 about the pin 104 by force transmitted through the spring 120. The downward pivoting of the transfer bar 124 allows the first stage spring plunger 132 to push the sear 126 forward, thereby reconnecting it with the hammer 122 and leaving the trigger assembly 100 recocked. The transfer bar 124 pivots upward by force of the spring 120, thereby reconnecting it with the sear 126.

Figure 3D:
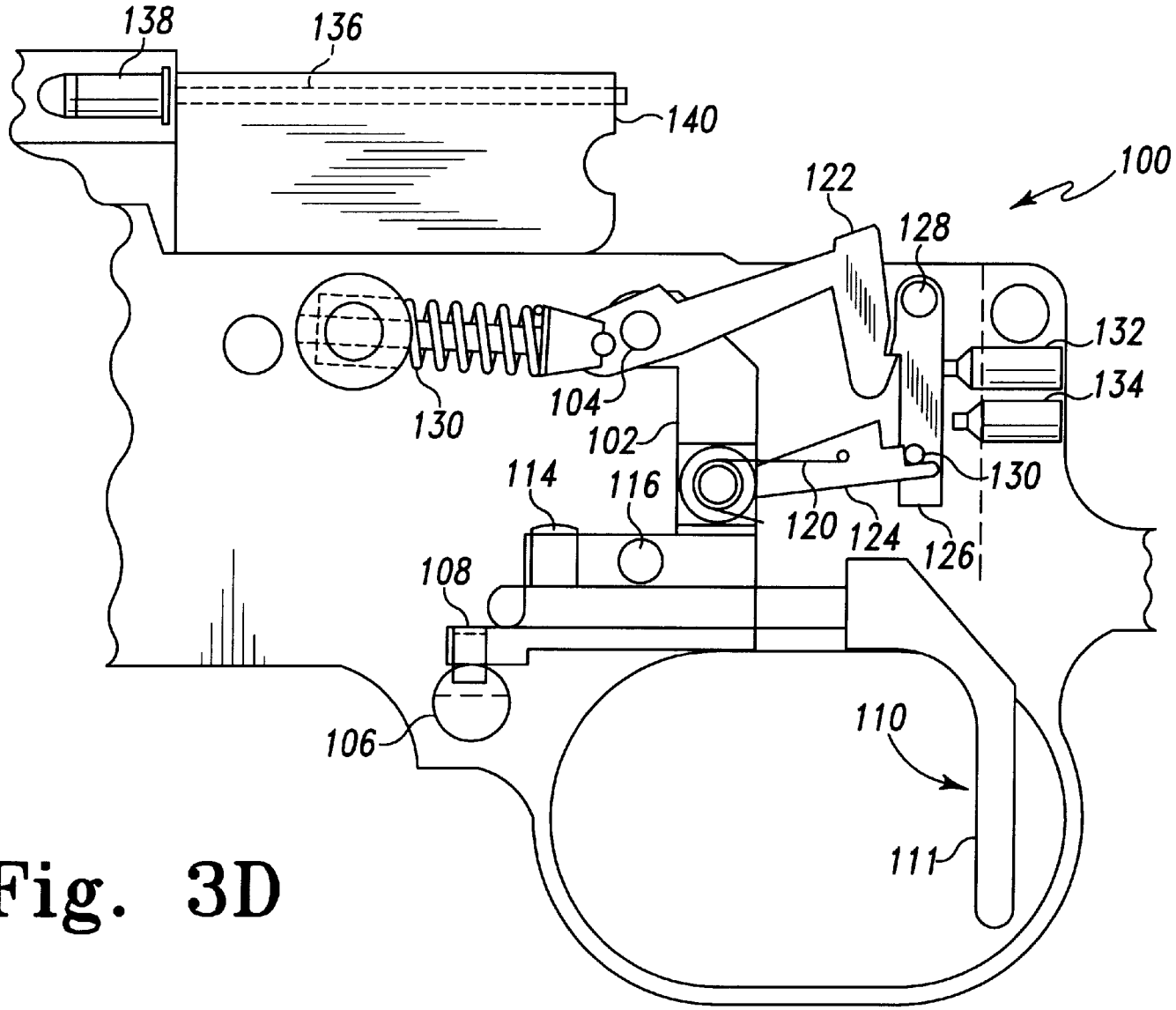

Referring to FIG. 3D, a new cartridge 138 is pushed into the chamber by means of an internal spring (not shown), and the bolt 140 is slid forward until it abuts the chamber by means of another internal spring (not shown). The trigger assembly 100 is now ready to fire again. It will be appreciated by those skilled in the art that the trigger assembly 100 is semi-automatic, in that the trigger assembly 100 automatically resets itself after every firing of the rifle, thereby allowing the rifle to be continuously fired with successive pulls of the trigger 110. It will be further appreciated by those skilled in the art that placement of the first stage spring plunger 132 farther away from the trigger 110 than the second stage spring plunger 134 creates an advantageous maximum length lever arm which significantly reduces the amount of pull force necessary to move the trigger 110 through the first stage. This is highly advantageous in match competition, where the large pull forces necessary to operate prior art two stage semi-automatic trigger assemblies precluded their use due to movement of the gun produced by the required muscle movement. The present invention therefore allows the use of a semi-automatic rifle with a two stage trigger assembly in match competition.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A two stage match trigger assembly, comprising:

a first pivot pin;

a hammer rotatably mounted to the first pivot pin;

biasing means coupled to the hammer and operative to urge the hammer to rotate about the first pivot pin;

a second pivot pin;

a sear rotatably mounted to the second pivot pin and releasably engaging the hammer, said engagement preventing rotation of the hammer about the first pivot pin;

a trigger having a trigger pulling surface, said trigger rotatably mounted to the first pivot pin and releasably engaging the sear, wherein rotation of the trigger about the first pivot pin causes rotation of the sear about the second pivot pin;

a first stage spring plunger operable to resist rotation of the sear about the second pivot pin; and a second stage spring plunger operable to resist rotation of the sear about the second pivot pin;

wherein pulling on the trigger pulling surface causes the trigger to rotate about the first pivot pin, which causes the trigger to engage the sear and thereby rotate the sear about the second pivot point, which causes the sear to compress the first stage spring plunger, then the second stage spring plunger, causing the sear to disengage from the hammer, whereupon the biasing means causes the hammer to rotate about the first pivot point; and wherein the first stage spring plunger is farther from the trigger pulling surface than the second stage spring plunger, resulting in a longer lever arm working on the first stage spring plunger than on the second stage spring plunger when the trigger pulling surface is pulled.

2. The trigger assembly of claim 1, wherein the trigger further comprises:

a pivot bar rotatably mounted to the first pivot pin;

a trigger having a trigger pulling surface, said trigger mounted to the pivot bar; and a transfer bar rotatably mounted to the pivot bar and releasably engaging the sear.

3. The trigger assembly of claim 2, wherein the trigger further comprises a spring mounted to the pivot bar and engaging the transfer bar, wherein the spring urges the transfer bar to rotate with respect to the pivot bar.

4. The trigger assembly of claim 2, wherein the pivot bar further includes a channel for adjustably mounting the trigger to the pivot bar by sliding said trigger into said channel, thereby providing an adjustable length of pull.

5. The trigger assembly of claim 4, further comprising a set screw mounted to the pivot bar and extending into the channel, wherein interaction between the set screw and the trigger fixes a position of the trigger with respect to the pivot bar.

6. A two stage match trigger assembly, comprising:

a first pivot pin;

a hammer rotatably mounted to the first pivot pin;

biasing means coupled to the hammer and operative to urge the hammer to rotate about the first pivot pin;

a second pivot pin;

a sear rotatably mounted to the second pivot pin and releasably engaging the hammer, said engagement preventing rotation of the hammer about the first pivot pin;

a pivot bar rotatably mounted to the first pivot pin;

a trigger having a trigger pulling surface, said trigger mounted to the pivot bar;

a transfer bar rotatably mounted to the pivot bar and releasably engaging the sear;

wherein rotation of the pivot bar about the first pivot pin causes rotation of the sear about the second pivot pin;

a first stage spring plunger operable to resist rotation of the sear about the second pivot pin; and a second stage spring plunger operable to resist rotation of the sear about the second pivot pin;

wherein pulling on the trigger pulling surface causes the pivot bar to rotate about the first pivot pin, which causes the transfer bar to engage the sear and thereby rotate the sear about the second pivot point, which causes the sear to compress the first stage spring plunger, then the second stage spring plunger, causing the sear to disengage from the hammer, whereupon the biasing means causes the hammer to rotate about the first pivot point; and wherein the first stage spring plunger is farther from the trigger pulling surface than the second stage spring plunger, resulting in a longer lever arm working on the first stage spring plunger than on the second stage spring plunger when the trigger pulling surface is pulled.

7. The trigger assembly of claim 6, wherein the trigger further comprises a spring mounted to the pivot bar and engaging the transfer bar, wherein the spring urges the transfer bar to rotate with respect to the pivot bar.

8. The trigger assembly of claim 6, wherein the pivot bar further includes a channel for adjustably mounting the trigger to the pivot bar by sliding said trigger into said channel, thereby providing an adjustable length of pull.

9. The trigger assembly of claim 8, further comprising a set screw mounted to the pivot bar and extending into the channel, wherein interaction between the set screw and the trigger fixes a position of the trigger with respect to the pivot bar.

* * * * *